US011160400B1

(12) United States Patent
Mani

(10) Patent No.: US 11,160,400 B1
(45) Date of Patent: Nov. 2, 2021

(54) TRAVEL PILLOW

(71) Applicant: Marc Mani, Beverly Hills, CA (US)

(72) Inventor: Marc Mani, Beverly Hills, CA (US)

( * ) Notice: Subject to any disclaimer, the term of this patent is extended or adjusted under 35 U.S.C. 154(b) by 14 days.

(21) Appl. No.: 17/100,296

(22) Filed: Nov. 20, 2020

(51) Int. Cl.
*A47G 9/10* (2006.01)

(52) U.S. Cl.
CPC ..... *A47G 9/1081* (2013.01); *A47G 9/1045* (2013.01); *A47G 2009/1018* (2013.01)

(58) Field of Classification Search
CPC ..... A47G 9/1081; A47G 9/1045; A47G 2009/1018
USPC ..... 5/636; D6/601
See application file for complete search history.

(56) References Cited

U.S. PATENT DOCUMENTS 4,031,578 A 6/1977 Sweeney
4,447,922 A * 5/1984 Brochu ..... A47D 1/103 297/391
D396,594 S * 8/1998 Lefebvre ..... D6/601
D407,256 S * 3/1999 Backlund ..... D6/601
6,010,192 A 1/2000 King
6,052,848 A * 4/2000 Kelly ..... A47C 20/021 5/630
8,566,986 B1 * 10/2013 Chu ..... A47G 9/1054 5/636
8,584,285 B1 11/2013 Sipherd
8,898,849 B2 12/2014 Vlajette
D725,407 S * 3/2015 McCracken ..... D6/601
9,434,283 B2 9/2016 Spalter
D769,029 S 10/2016 Okwumabua
D787,232 S 5/2017 Arabo
D808,195 S * 1/2018 Wyborn ..... D6/601
D823,026 S * 7/2018 Shi ..... A47C 7/383 D6/601
D910,339 S * 2/2021 Dennewald ..... D6/601
D913,012 S * 3/2021 Krishtul ..... D6/601
D915,104 S * 4/2021 Yang ..... D6/601
2006/0267392 A1 11/2006 Charnitski
2007/0022537 A1 * 2/2007 Faustick ..... A47D 13/08 5/655
2007/0199151 A1 * 8/2007 Brown ..... A61F 5/3707 5/655
2010/0237677 A1 * 9/2010 Nam ..... B60N 2/803 297/410
2012/0110742 A1 * 5/2012 Lawler ..... A61G 13/1225 5/632
2012/0255126 A1 * 10/2012 Abdo ..... A47G 9/109 5/638
2013/0232693 A1 * 9/2013 Myers ..... A47C 7/383 5/636

(Continued)

FOREIGN PATENT DOCUMENTS

GB 2510644 A 8/2014
KR 101538695 B 7/2015
KR 20150092658 A 8/2015

*Primary Examiner* — Myles A Throop

(57) ABSTRACT

The travel pillow assembly includes a travel pillow designed to provide optimal head support for the user in erect and supine positions. The travel pillow is configured with a hole to securely support the occiput and is tapered in a manner that maintains the user's neck and head in proper alignment. The travel pillow assembly is constructed of single piece foam which is firm enough and contoured to prevent head turning and neck torsion. The travel pillow assembly also includes an adjustable strap that may be used to provide supplemental support to the head.

14 Claims, 10 Drawing Sheets

(56) References Cited

U.S. PATENT DOCUMENTS

| | | | | |
|---|---|---|---|---|
| 2015/0121626 | A1 | 5/2015 | Carver | |
| 2015/0173516 | A1* | 6/2015 | Erbe | A47C 7/383 5/636 |
| 2019/0008294 | A1* | 1/2019 | Marshall | A47G 9/10 |
| 2019/0182593 | A1* | 6/2019 | Guerrini | H04R 1/26 |
| 2019/0231099 | A1* | 8/2019 | Davis | A47G 9/10 |
| 2020/0154914 | A1* | 5/2020 | Popitz | A61F 5/56 |

* cited by examiner

TRAVEL PILLOW

FIELD OF INVENTION

The present invention relates to a travel pillow. More specifically, the present invention provides an improved travel pillow which supports neck and head of a user in both supine and erect position.

BACKGROUND OF THE INVENTION

A pillow generally provides cushioning for the head and neck, typically in a supine position. A travel pillow provides firm support to the neck to prevent a person's head from dropping forward or back or falling to one side or another. A travel pillow must support the person's neck usually while a vehicle is in motion. The travel pillow also provides support to the neck and head of the person, often while in sitting position through a range of angles, as is common while traveling on long journeys in automobiles, trains, buses, airplanes and the like. A common problem for the travelers is not being able to sleep when traveling. Further, there are innumerable situations, for instance waiting at the airport for hours for a delayed flight, where the lack of headrests on the seats makes resting uncomfortable for the passengers. There are a variety of head and neck travel pillows that are currently available in the market that attempt to address this concern, but none of them provides sufficient support and comfort when sleeping while sitting during travelling, for instance in an airplane.

SUMMARY OF THE INVENTION

The present invention provides an improved travel pillow which may be used for resting and sleeping in home or while traveling, for instance on an airplane. The travel pillow assembly comprises a travel pillow configured to support the neck and head of a user in supine position and a strap. The travel pillow assembly further includes a pair of side rests that extend from the shoulders to the top of the user's head, while in an upright position. The travel pillow further includes a headrest in between the pair of side rests for supporting the occiput portion of the head. The head rest is slightly depressed in comparison with the pair of side rests, to align the head and neck of the user in the forward position while the user's head is in supine or erect position.

The head rest of the travel pillow further includes a top portion, a central portion and a bottom portion. The bottom portion of the travel pillow is configured into an arch shape that is designed to rest on the shoulders of the user. Further, the arch extends from one side rest to the other side rest. The top of the arch is at the base of the head rest and the bottom of the arch is at the base of the side rests and rests on the shoulders to the front of the user's chest. The central portion of the head rest supports the middle portion of the head. The central portion further includes a hole for supporting the occiput or occipital part of the head. Moreover, the region from the central portion of the hole to the lower portion of the arch is tapered for accommodating neck in proper alignment, while the user reclines the head while resting. The top portion of the headrest supports posterior part of the head. The top portion of the headrest is tapered for accommodating the head in proper alignment, while resting.

The travel pillow further optionally includes a strap placed at bottom of the headrest for supporting the travel pillow in place relative to the head. The strap may be attached to the headrest such that it tightens from side to side to secure the headrest against the user's head. It may be is further wrapped around the neck starting from one of the pair of side rests via the headrest to connect with other side rest. Furthermore, the strap further includes a connector to secure one side of the strap with the other. The connector here is either of a button, Velcro® hook and loop assembly, hooks, and/or buckles and the like to connect the strap together. It will be appreciated that the strap may be used in different configurations so long as it secures the head rest against the user's head.

A primary objective of the present invention is to provide a travel pillow assembly for supporting neck and head of a user in supine position. The travel pillow portion is made from a single piece of foam that is firm enough to accomplish support against the head movement in a reclined seated position such as in an airplane or sleeping in erect position.

An objective of the present invention is to provide a firm yet soft travel pillow that supports the head and neck while resting or travelling in an upright position or a supine position.

Another objective of the present invention is to provide a travel pillow assembly that is strong enough to provide support against the head movement and neck torsion which is the main impediment to sleep in the upright or reclined seated position such as in an airplane.

Yet another objective of the present invention is to provide a travel pillow assembly that is made up of single piece polyester, polyurethane, latex, visco-elastic or memory foam.

Another objective of the present invention is to provide a travel pillow assembly has a concave recess for the occiput to rest and contours to the cervical region to support its natural lordosis, when the user reclines the head while resting or travelling.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

The presence of broadening words and phrases such as "one or more," "at least," "but not limited to" or other like phrases in some instances shall not be read to mean that the narrower case is intended or required in instances where such broadening phrases may be absent.

BRIEF DESCRIPTION OF DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

FIG. 2 (*b*) illustrates a back view of the headrest of the travel pillow in accordance with the present invention;

FIG. 2 (*c*) illustrates a side view of the headrest of the travel pillow from the head on view, in accordance with the present invention;

FIG. 2 (*d*) illustrates a side view of the headrest of the travel pillow from the head on view, in accordance with the present invention;

FIG. 2 (*e*) illustrates a top view of the headrest of the travel pillow in accordance with the present invention;

FIG. 2 (*f*) illustrates a bottom view of the headrest of the travel pillow in accordance with the present invention.

DETAILED DESCRIPTION

A variety of travel pillows have been described. One such example is described in U.S. Pat. No. 9,434,283 assigned to Danami Llc disclosing a travel pillow for use on vehicle seats, for example airplanes during long trips. The travel pillow provides support to the head in the superior direction or anterior direction with control of twisting movement of the head in the forward direction and/or the lateral direction. Though the pillow described therein provides support to the head and neck of the person, it is too bulky around the back of the neck and does not allow the shoulders to rest properly.

Another Korean Patent KR101538695 assigned to Young-hwan Park discloses a three-dimensional pillow that allows resting comfortably while sitting on a chair by allowing the head and neck portions to maintain a stable posture at all times while travelling. The travel pillow described therein may provide adequate support to the neck and head of the person while the person is sleeping. However, the pillow does not provide enough space for aligning the neck in upright or erect position.

Another example is U.S. Pat. No. 8,584,285B1 assigned to Ryan Sipherd which discloses a U-shaped travel pillow contoured for neck support and lateral head support. This pillow supports the head and neck posteriorly but depends upon a "deflection relief" slot posteriorly to bend the head buttresses inward to engage the head and neck for lateral support. This design lacks head buttresses of adequate depth to provide head and neck support laterally and does not rest upon or contour to the shoulders in a way that resists lateral head and neck movement or twisting while in the semi-reclined or upright seated position.

In view of the defects in design of the travel pillows in the prior art, there exists a significant need for an improved pillow to stabilize the head of a user, also referred to herein as a travel pillow. Notably, there exists a need for a travel pillow that is tailored and customized to maximize comfort of the user. For instance, there exists a need to develop a travel pillow that will not push the head forward or allow the head to fall in a rearward position.

Accordingly, the present disclosure provides an improved travel pillow that is configured to support a user's head and/or neck in multiple positions while sleeping in the upright or reclined seated position such as in an airplane. The travel pillow is constructed from a single piece foam that provides excellent vertical support, lateral support and head cushioning to the user's head. The head rest is soft yet strong enough to provide support against head rotation and neck torsion, in a reclined seated position such as in an airplane or sleeping in erect position. The travel pillow has a concave recess for the back portion of the head to rest and contours to the cervical region to improve its natural lordosis.

Figure 1:
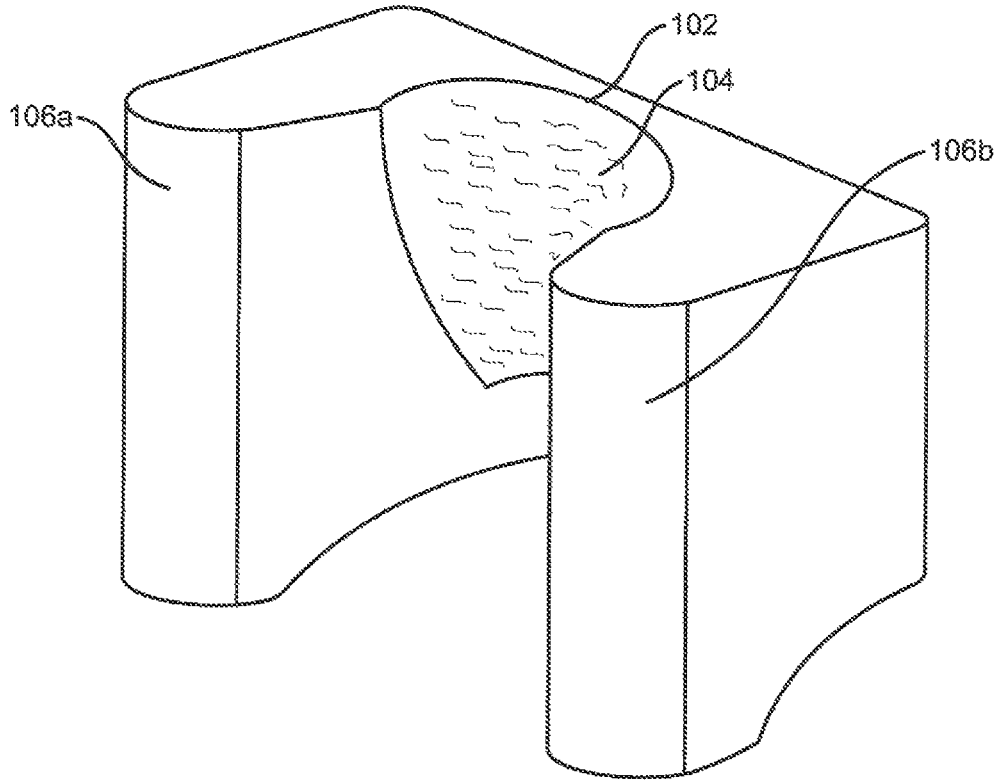
FIG. 1 illustrates a perspective view of a travel pillow of a travel pillow.
Figure 2A:
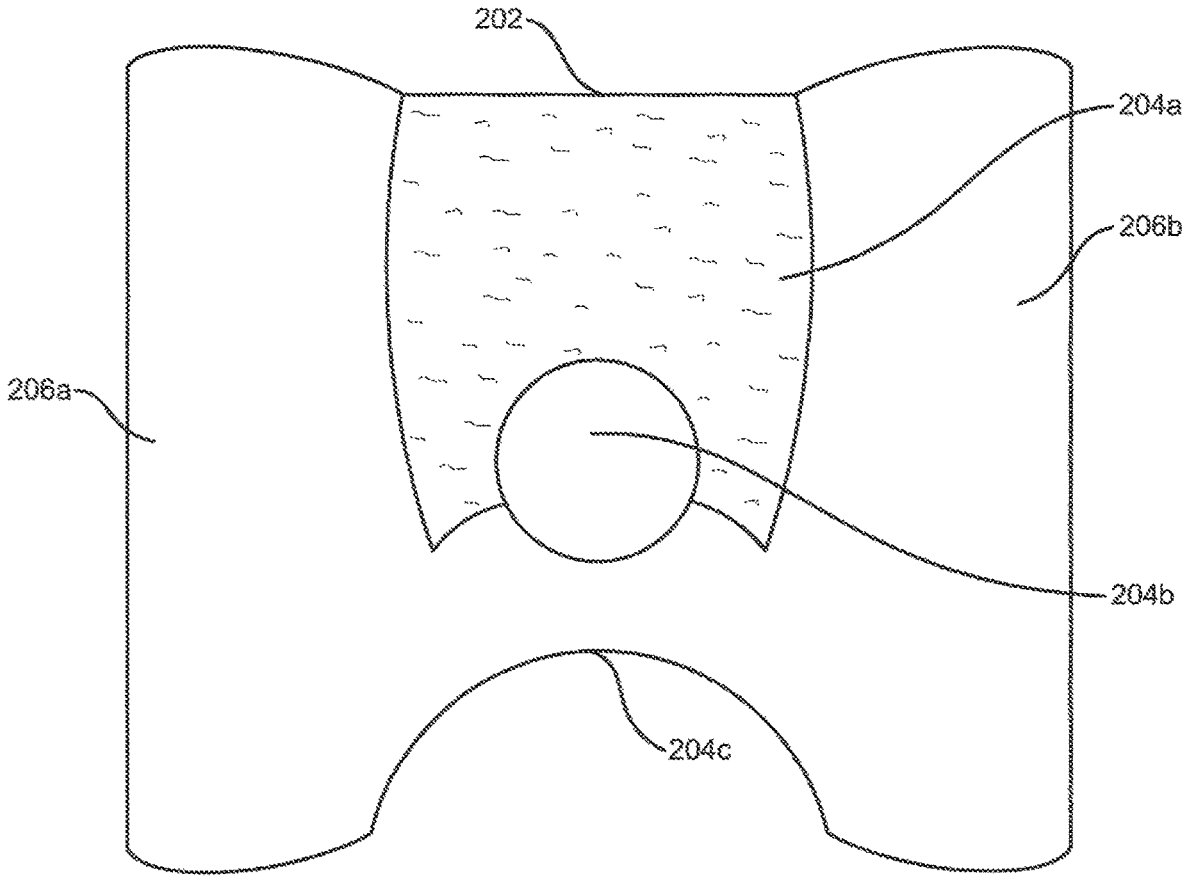
FIG. 2 (*a*) illustrates a front view of a headrest of the travel pillow in accordance with the present invention.
Figure 2B:
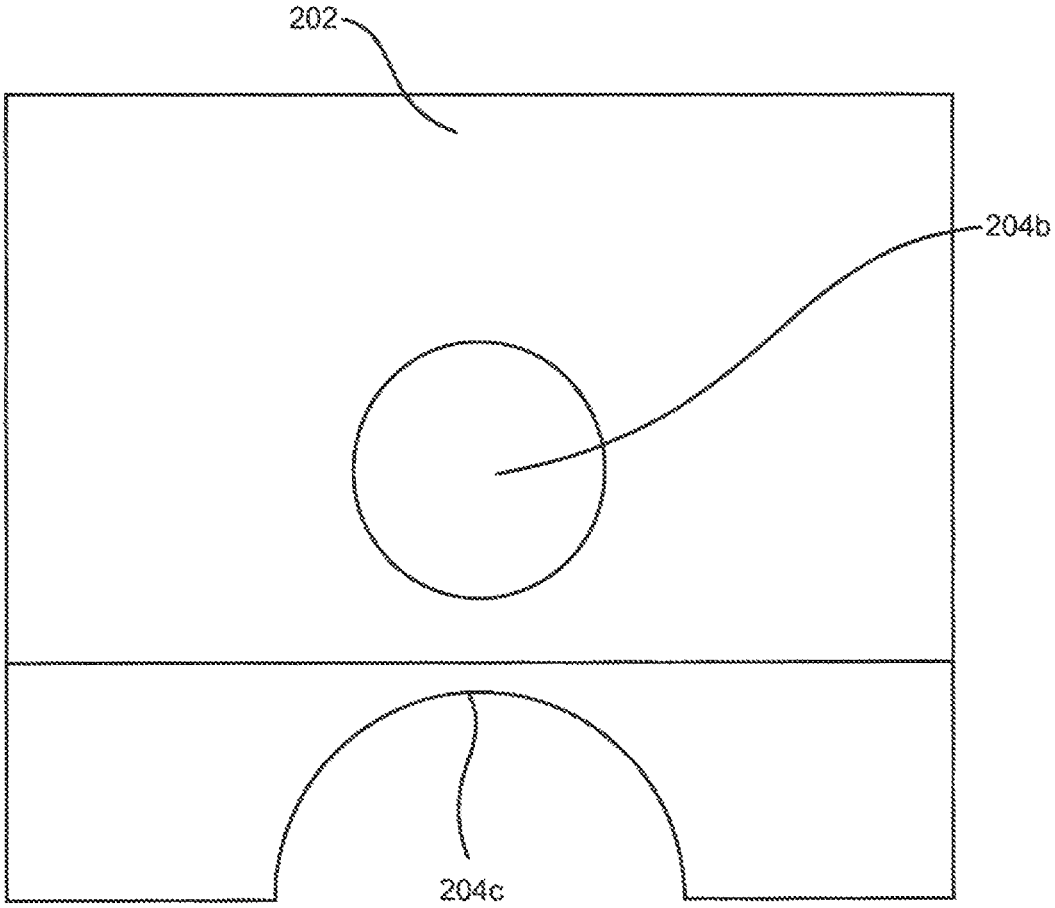
Figure 2C:
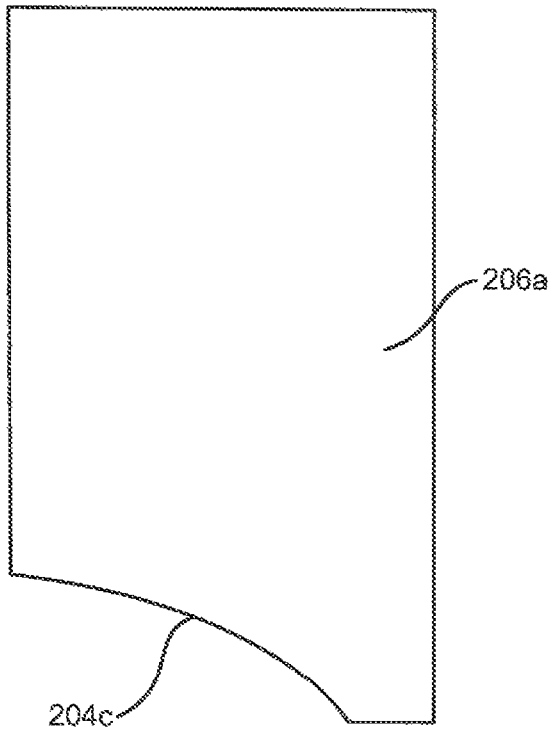
Figure 2D:
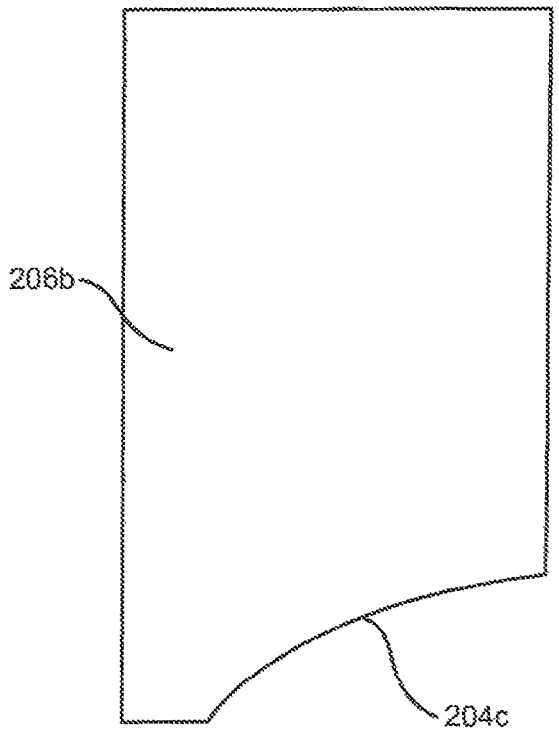
Figure 2E:
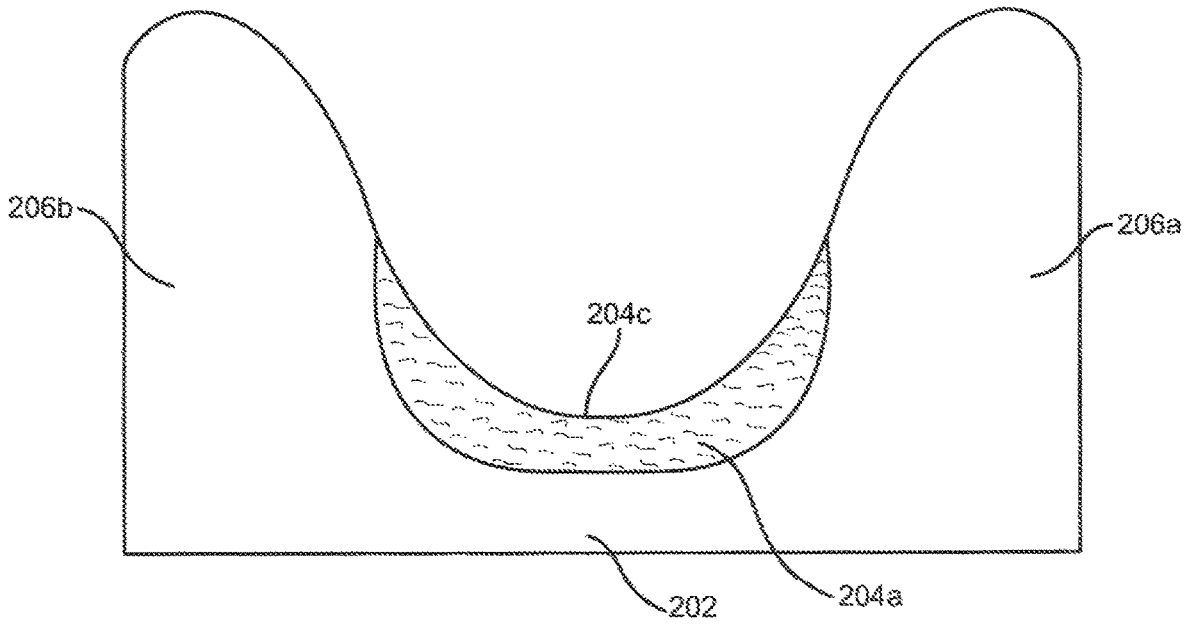
Figure 2F:
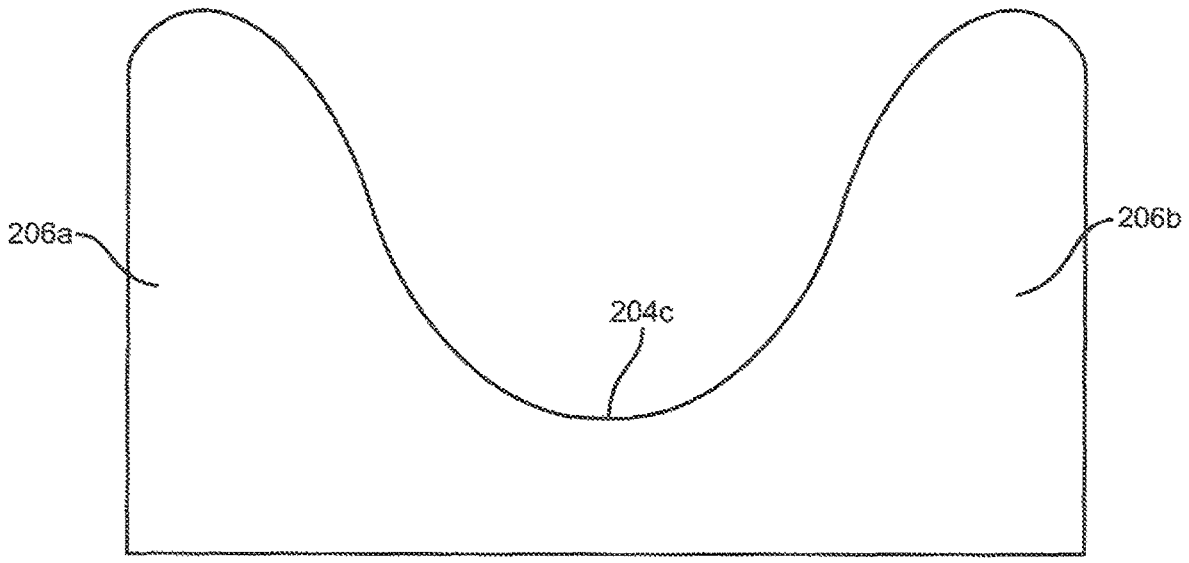

FIG. 1 illustrates a perspective view of the travel pillow (102) embodying aspects of the present invention. In accordance of the present invention, the travel pillow (102) is configured to support the neck and/or head of a user, while the user is resting in seated position. The travel pillow (102) also provides vertical and lateral support to the head of the user. The travel pillow (102) further comprises a head rest (104) and a pair of side rests (106) that in some embodiments may be identical with each other, and that are configured to cover the left and right side of the user's head. Each side rest (106*a*, 106*b*) is configured to cover the left side and right side of the user's head, from shoulder to the top of the head. The travel pillow (102) can be customized according to the user, i.e. may be sized and shaped to match the approximate shape of the user's head. Each side rest (106*a*, 106*b*) may be sized such that the user's ears do not contact the travel pillow when the head is at least in the center forward facing position.

The headrest (104) of the travel pillow further is concavely recessed between the pair of side rests (106) for supporting the back portion of the head. The head rest (104) is depressed inwards, to align the head and neck of the user in the forward position, when the user is resting or sleeping during travelling. The head rest (104) of the travel pillow (102) further includes a top portion, a central portion and a bottom portion.

The top portion of the head rest (104) of the travel pillow (102) supports the anterior posterior part or top portion of the head of the user. In one embodiment of the present invention, the top portion of the head rest (104) is tapered for accommodating head in proper alignment, while the user reclines their head during resting. The central portion of the head rest (104) of the travel pillow (102) supports the middle portion of the head. The central portion further comprises a hole for supporting the occiput part of the head.

The bottom portion of the travel pillow (102) is shaped into arcuate shape for resting the travel pillow (102) on the shoulder of the user, so as to remain in position without falling off the shoulder. In one embodiment of the present invention, the top of the arc-shape bottom portion is at the base of the head rest (104) and bottom of the same lie at the base of the side rest (106*a*, 106*b*) of the travel pillow (102) and is arched toward the front of the user such that the bottom of the sides rest on the shoulder and chest of the user.

The travel pillow (102) may be made up of a single piece foam material. The single piece foam material is designed and configured in a way to form a head and neck supporting portion of the travel pillow (102). Primarily, the single piece travel pillow (102) includes a pair of side rests (106) on each side of a head rest (104), the side rests (106) are angled upwards with respect to the head rest (104), for supporting the left and right portions of the head. The thickness of each side rest symmetrically reduces towards the head rest (104) of the travel pillow (102). Alternatively, the single piece travel pillow (102) includes a pair of side rests (106) on each side of a head rest (104). In some embodiments the pair of side rests (106) are not identical.

In one embodiment of the present invention, the travel pillow (102) is made up of a conformable foam material that conforms to the shape of head, neck and shoulder of the user, and this support provides additional comfort and stability on the shoulder. In some embodiments the travel pillow (102) is constructed from a memory foam or visco-elastic foam. In alternative embodiment, the foam is either a polyurethane foam or latex foam.

In alternative embodiment, the travel pillow (102) may also be provided with a removable cover or case, to protect the pillow and may be removed for cleaning or replacement thereof. The removable cover may be designed as per the dimensions and design of the travel pillow (102). The cover of the travel pillow (102) is fabricated primarily of a soft fabric, such as fleece or cotton. Other materials may be used depending upon environmental considerations or user preferences.

FIG. 2 (*a*) illustrates a front view of travel pillow (202) constructed by the single piece foam showing the head rest (204) and a pair of side rest (206*a*, 206*b*) of the travel pillow (202). Primarily, the head rest (204) includes a top portion (204*a*), a head rest hole (204*b*) and the head rest bottom (204*c*). In some embodiments the top portion is tapered from thicker at the top to thinner towards the head rest hole (204*b*). In some embodiments the bottom portion (204*c*) is tapered from thicker at the bottom and thinner toward the head rest hole (204*b*). The head rest hole (204*b*) is configured to support the occiput of the head of the user. The bottom portion (204*c*) is configured in an arch shape. In some embodiments, the hole can also act as a drink holder or tray table, when the travel pillow (202) is not in use or when the pillow is placed face down over knee of the user. In one embodiment of the present invention, the shape of the hole (204*b*) is circular.

In alternative embodiments of the present invention, the shape of the hole (204*b*) is either an elliptical, square, triangular or any other shape. In alternative embodiment of the present invention, the diameter of the hole (204*b*) is around 5-10 cm. In some embodiments the hole is around 7 cm in diameter. In some embodiments the width of the travel pillow (202) ranges from around 30-40 cm. More particularly, the width of the travel pillow (202) is around 30 cm.

In an embodiment, the width of the head rest (204) ranges from around 12 cm to around 20 cm. More particularly described, the width of the head rest (204) is around 14 cm. Moreover, the height of the head rest (204) ranges from 16 cm to 26 cm. More particularly, the height of the head rest portion (204) is around 19 cm.

The bottom portion (204*c*) of the head rest (204) is curved in arc shape at some height from the bottom of the side rest (206*a*, 206*b*). For instance, the height at which the bottom portion is configured in an arc-shape, ranges from around 6 cm to around 16 cm. More particularly, the height of the arc shaped bottom portion the side rest (206) is around 6 cm from the bottom to the bottom of the head rest (204). In other words, the distance between the top of the arch which is at the base of the headrest (204) and the bottom of the arch, which is at the base of the side rest (206*a*, 206*b*) is around 6 cm.

Also as further depicted in FIG. 2 (*a*), it is evident that the side rests (206*a*, 206*b*) are separated at specific distance, depending upon the head, neck and shoulder anatomy of the user, so that the travel pillow easily accommodates users of varying sizes. The distance between the side rests (206*a*, 206*b*) ranges from around 16 cm to around 26 cm. More particularly, the distance between the side rests (206*a*, 206*b*) is around 16 cm. In some embodiments the distance between the side rests is 16, 17, 18, 19, 20, 21, 22, 23, 24, 25 or 26 cm. In some embodiments the width of the travel pillow (202) is around 30-40 cm. In some embodiments the width of the travel pillow is around 30, 31, 32, 33, 34, 35, 36, 37, 38, 39 or 40 cm. More particularly, the width of the travel pillow (202) is around 30 cm.

FIG. 2 (*b*) illustrates a back view of travel pillow (202) constructed by the single piece foam showing the posterior portion of the travel pillow (202). The travel pillow (202) is around 30-40 cm wide in some embodiments. In some embodiments the width of the travel pillow is around 30, 31, 32, 33, 34, 35, 36, 37, 38, 39 or 40 cm. More particularly, the width of the travel pillow (202) is around 30 cm.

FIG. 2 (*c*) illustrates a side view of headrest of the travel pillow (202) constructed by the single piece foam showing a view of the side rest (206*a*) of the travel pillow (202). The anterior of the travel pillow is to the right. The posterior of the travel pillow is to the left. In an embodiment in accordance to the invention, the side rest (206*a*) has a height ranging from around 25 cm to around 35 cm. In some embodiments the side rest has a height of around 25, 26, 27, 28, 29, 30, 31, 32, 33, 34 or 35 cm. More particularly, the height of the side rest (206) is around 25 cm. For a larger or smaller sized pillow, the dimensions of the travel pillow (202) would be increased or decreased, respectively, to accommodate the head, neck, and shoulder anatomy of a user of that size, the same being known to one of ordinary skill in the art.

FIG. 2 (*d*) illustrates a side view of travel pillow (202) constructed by the single piece foam showing a view of the side rest (206*b*) of the travel pillow (202). The anterior of the travel pillow is to the left. The posterior of the travel pillow is to the right. The side rest (206*b*) has a height ranging from around 25 cm to around 35 cm. In some embodiments the side rest has a height of around 25, 26, 27, 28, 29, 30, 31, 32, 33, 34 or 35 cm. More particularly, the height of the side rest (206) is around 25 cm. In some embodiments the left and right side rests (206*a*, 206*b*) are identical, although this is not required in all embodiments. That is, in some embodiments the sides are not identical.

FIG. 2 (*e*) illustrates a top view of the travel pillow (202) showing the view of the top portion of the head rest (204). As shown in FIG. 2(*e*) the headrest (204) portion is configured in curved shape from center towards the top portion (204*a*) within the head rest. It is evident from this figure that the thickness of this portion decreases as the head rest (202) slopes from the center towards the top. The radius of curvature of the headrest rest (204) ranges from 8 cm to 16 cm. An acceptable radius of curvature is 8 cm. In some embodiments the radius of curvature is from 2.5 to 5 cm, i.e. the diameter is 5 to 10 cm.

FIG. 2 (*f*) illustrates a bottom view of travel pillow (202) showing the bottom view of headrest (204). The region from the central portion of the hole to the lower portion of the arch shape bottom portion (204*c*) is carved for accommodating neck of the user in proper alignment, while the user reclines their head during resting.

Figure 3:
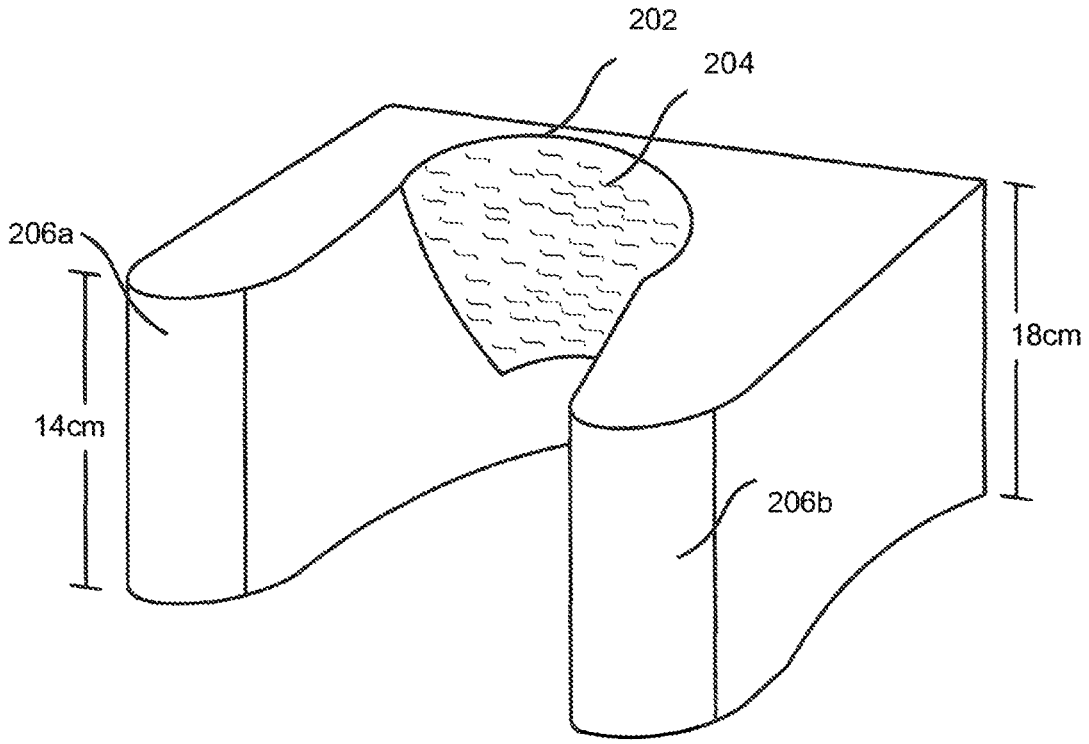
FIG. 3 illustrates a travel pillow having tapered sides in which the back is longer than the front.

FIG. 3 illustrates and alternative configuration of the travel pillow (202). In this embodiment the travel pillow comprises tapered sides in which the back of the travel pillow is longer than the front of the travel pillow. Such a configuration finds use when space may be limited for the traveler and the smaller profile of the pillow may be beneficial. For instance, as exemplified in the figure, the back of the travel pillow may be around 14-20 cm, more preferably 16-18 cm, more preferably 18 cm high, while the front of the travel pillow may be around 10-15 cm, more preferably 12-14 cm, or more preferably 14 cm high. In some embodiments, the height of the front of the travel pillow is 5%, 10%, 15%, 20%, 25% or 30% shorter than the height of the back of the travel pillow.

Figure 4:
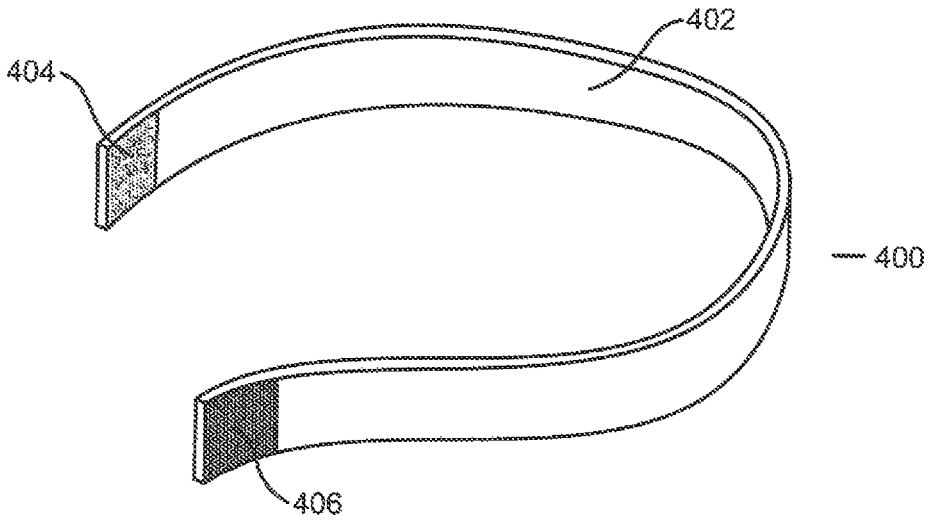
FIG. 4 illustrates a strap of the travel pillow in accordance with the present invention.

FIG. 4 illustrates a strap 402 of the travel pillow assembly 500 (see FIG. 5) in accordance with the present invention. A strap (402) is provided for holding the travel pillow (102) in place with the head. The strap (402) may engage with the travel pillow (102) in a variety of configurations. Considering the travel pillow in FIG. 1, the strap (402) may be placed at bottom of the travel pillow (102) for supporting the travel pillow (102) in place relative to the head of the user. In one configuration the strap (402) is extended in front of the neck starting from one side rest (106) to the other side rest (106).

The strap (400) may be made of elastic material, which is stretchable enough to accommodate the neck of the user. Moreover, the strap (400) provides a support to the travel pillow (102) for keeping the head rest in place relative to the head of the user. Furthermore, the strap may be made of elastic cotton material. In other embodiments, the strap also may be a belt that supports the travel pillow (102) in place relative to the head of the user. In one embodiment of the present invention, the width of the strap ranges from around 4.5 cm to 6 cm. More particularly, the width of the strap is around 4.5 cm, which secures the travel pillow (102) in place relative to the head of the user.

The strap (400) comprises a central component (402), which may be made of a variety of materials, and a connector with a male member (404) and a female member (406) to secure one side of the central component (402) to the other. Primarily, the connector is made of Velcro® hook and loop assembly, connectors with a male and a female member. Alternatively, the connector may be a button, hooks, and/or buckles to connect the strap (400) ends together.

Figure 5:
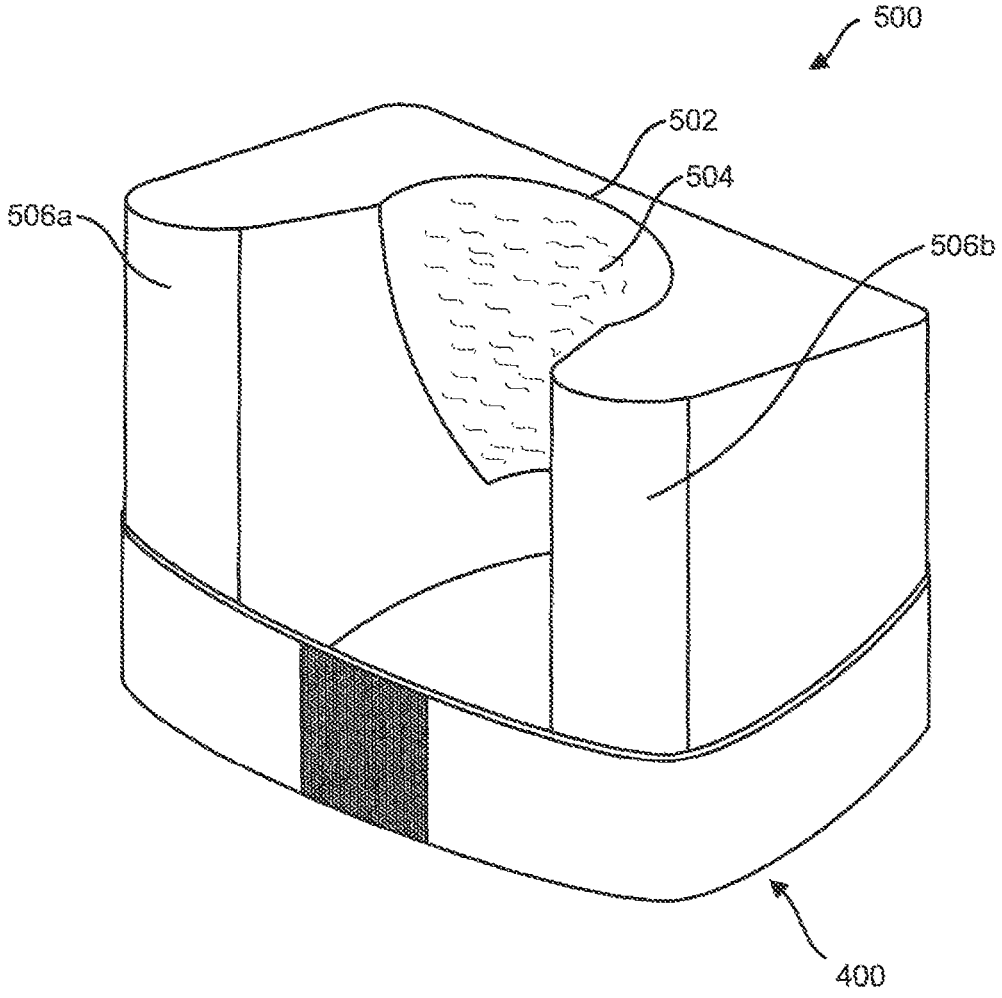
FIG. 5 illustrates a perspective view of the travel pillow assembly.

FIG. 5 illustrates a perspective view of the travel pillow assembly (500). In accordance of the present invention, the travel pillow assembly (500) comprises a travel pillow (502) configured to support the neck and/or head of a user, in supine or in erect position. The travel pillow (502) also provides vertical and lateral support to the head of the user. The travel pillow (502) further comprises a head rest (504) and a pair of side rests (506) that in some embodiments may be identical with each other, and that are configured to cover the left and right side of the user's head. Each side rest (506*a*, 506*b*) is configured to cover the left side and right side of the user's head, from shoulder to the top of the head. The side rests (506*a*, 506*b*) may be sized such that the user's ears do not contact the travel pillow when the head is at least in the center forward facing position.

The headrest (504) of the travel pillow further is concavely recessed between the pair of side rests (106) for supporting the back portion of the head. The head rest (504) is depressed inwards, to align the head and neck of the user in the forward position, when the user is resting or sleeping during travelling. The head rest (504) of the travel pillow (502) further includes a top portion, a central portion and a bottom portion.

The top portion of the head rest (504) of the travel pillow (502) supports the anterior posterior part or top portion of the head of the user. In one embodiment of the present invention, the top portion of the head rest (504) is tapered for accommodating head in proper alignment, while the user reclines their head during resting. The central portion of the head rest (504) of the travel pillow (502) supports the middle portion of the head. The central portion further comprises a hole for supporting the occiput part of the head.

The bottom portion of the travel pillow (502) is shaped into arcuate shape for resting the travel pillow (502) on the shoulder of the user, so as to remain in position without falling off the shoulder. In one embodiment of the present invention, the top of the arc-shape bottom portion is at the base of the back rest (504) and bottom of the same lie at the base of the side rest (506*a*, 506*b*) of the travel pillow (502) and is arched toward the front of the user such that the bottom of the sides rest on the shoulder and chest of the user.

The travel pillow assembly (500) further comprises a strap (400) that is placed at bottom of the travel pillow (502) for supporting the travel pillow (502) in place relative to the head of the user. The strap (400) may be configured to wrap in front of the neck of the user starting from one of the side rest (506*a*) to connect with another side rest (506*b*). Alternatively, the strap (400) may wrap around the travel pillow and in some embodiments may rest against the back of the neck of the user. The strap (400) is preferably used for holding the travel pillow (502) to the user in various support configurations. The strap (400) is preferably made of a durable and elastic material that conforms around the neck of the user easily. The length of the strap (400) may be adjusted depending on size and shape of the head and neck of the user.

The strap (400) further includes a male member and a female member that can be joined by using a connector to secure one side of the strap (400) to the other side of the same. In one embodiment, the connector is a Velcro® hook and loop assembly type connection. In other embodiment, the connector may be of button, hook and/or loop connectors, or other separable fasteners to enable attachment for properly holding the pillow at varying orientations.

The travel pillow assembly (500) includes a travel pillow (502), that is made up of a single piece foam material. The single piece foam material is designed and configured in a way to form a head and neck supporting portion of the travel pillow (502). Primarily, the single piece travel pillow (502) includes a pair of side rests (506) on each side of a head rest (504), the side rests (506) are angled upwards with respect to the head rest (504), for supporting the left and right portions of the head. The thickness of each side rest symmetrically reduces towards the head rest (504) of the travel pillow (502). Alternatively, the single piece travel pillow (502) includes a pair of side rests (506) on each side of a head rest (504). In some embodiments the pair of side rests (506) are not identical.

The travel pillow assembly (500) further includes a strap (400) placed at bottom of the travel pillow (502), wherein the strap (400) is wrapped from one of the side rests to the other side rest (506).

In one embodiment of the present invention, the travel pillow (502) of the travel pillow assembly (500) is made up of a conformable foam material that conforms to the shape of head, neck and shoulder of the user, and this support provides additional comfort and stability on the shoulder. In some embodiments the travel pillow (502) is constructed from a memory foam or visco-elastic foam. In alternative embodiment, the foam is either a polyurethane foam or latex foam.

In alternative embodiment, the travel pillow (502) may also be provided with a removable cover or case, to protect the pillow and may be removed for cleaning or replacement thereof. The removable cover may be designed as per the dimensions and design of the travel pillow (502). The cover of the travel pillow (502) is fabricated primarily of a soft fabric, such as fleece or cotton. Other materials may be used depending upon environmental considerations or user preferences.

Once made, the pillow, which has been referred to herein as a travel pillow, finds a variety of uses. In one embodiment the pillow finds use as a travel pillow. In alternative embodiments the pillow finds use in sleeping whether traveling or not. In a particular embodiment the pillow finds use with patients following surgery. Frequently following surgeries, patients are required to sleep on their back since the pillow encourages the ability to do that comfortably. This would apply to cosmetic surgeries in particular. Accordingly the disclosure herein provides a method of immobilizing a post-surgical patient by having the patient recline into the pillow as described herein, whereby the head of the post-surgical patient is immobilized.

While the various embodiments of the present invention have been described above, it should be understood that they have been presented by way of example only, and not of limitation. Likewise, the figure may depict an example architectural or other configuration for the invention, which is done to aid in understanding the features and functionality that can be included in the invention. The invention is not restricted to the illustrated example architectures or configurations, but the desired features can be implemented using a variety of alternative architecture and configurations.

The invention claimed is:

1. A travel pillow for supporting neck and head of a user in supine position, the travel pillow comprising:

a single, unitary head rest portion and first and second side rests for supporting the head of the user, wherein the head rest portion is positioned between the first and second side rests and wherein the head rest portion comprises:

a. a top portion comprising a concavely recessed region that extends from a bottom of the top portion to a top of the top portion wherein said concavely recessed region is from 5 cm to 10 cm wide and wherein said concavely recessed region comprises a radius of curvature that is larger at the top than the radius of curvature at the bottom of the concavely recessed region and wherein said concavely recessed region is configured to support the posterior part of the head and maintain the head in proper alignment;

b. a central portion with a hole of from 5 to 10 cm in diameter, wherein the hole supports the occipital part of the head; and c. an arch shaped bottom portion comprising a top and first and second bottom sections, wherein the top of the arch shaped bottom portion is configured to rest on a user's shoulders, further wherein the top of the arch shaped bottom portion is positioned at a base of the head rest, and the first and second bottom sections of the arch shaped bottom portion are positioned at the base of the first and second side rests, and wherein the first and second bottom sections are configured to protrude away from the headrest, over the user's shoulders to the front of the user's chest.

2. The travel pillow according to claim 1, wherein the travel pillow assembly is made up of a foam material.

3. The travel pillow according to claim 2, wherein the foam material is visco-elastic, polyester, polyurethane or latex.

4. The travel pillow travel pillow according to claim 1, further comprising a strap, wherein ends of the strap are connected with each other through hook and loop assembly, buckles, hooks or buttons.

5. The travel pillow according to claim 1, wherein a shape of the hole in the headrest portion is either of circular, triangular, elliptical or square.

6. The travel pillow according to claim 5, wherein the hole is configured to hold a drink.

7. The travel pillow according to claim 1, comprising a strap attached to each side rest, wherein the strap connects the pair of side rests.

8. The travel pillow according to claim 1, wherein each side rest comprises a front and back, wherein the back of each side rest abuts the headrest and the front of each side rest is taller than the back of each side rest.

9. The travel pillow according to claim 1, wherein the travel pillow is of 25-35 cm in length.

10. The travel pillow according to claim 1, wherein the headrest is of 15-25 cm in width.

11. The travel pillow according to claim 1, wherein each of the pair of side rests is of 20-30 cm in width.

12. The travel pillow according to claim 1, wherein diameter of curvature of the arch shape bottom is 12-20 cm.

13. The travel pillow according to claim 1, further comprising a strap, wherein width of the strap is 3-6 cm, wherein the strap is configured to wrap from one side rest to the other side rest.

14. The travel pillow according to claim 1, wherein said top portion is tapered from thicker at the top to thinner towards the head rest hole.

* * * * *